United States Patent [19]

Berger

[11] 3,978,599

[45] Sept. 7, 1976

[54] ILLUMINATED DISPLAY DEVICE

[75] Inventor: Barry D. Berger, Brooklyn, N.Y.

[73] Assignee: Thomson-Leeds, Company, Inc., New York, N.Y.

[22] Filed: Nov. 12, 1975

[21] Appl. No.: 631,269

Related U.S. Application Data

[63] Continuation-in-part of Ser. No. 536,896, Dec. 27, 1974, abandoned.

[52] U.S. Cl. ..... 40/132 R; 40/130 C; 40/134; 40/136

[51] Int. Cl.[2] ..... G09F 13/08

[58] Field of Search ..... 40/136, 132 R, 134, 40/130 C, 131 R, 133 B, 132 D, 130 R, 133 A

[56] References Cited

UNITED STATES PATENTS

| | | | |
|---|---|---|---|
| 1,482,790 | 2/1924 | Gmelin | 40/133 B |
| 1,688,196 | 10/1928 | Masson | 40/136 X |
| 2,588,183 | 3/1952 | Vigon | 40/134 |
| 2,699,620 | 1/1955 | Smythe | 40/134 X |
| 2,756,528 | 7/1956 | Silver | 40/136 |
| 2,769,263 | 11/1956 | Wamser | 40/132 R |
| 2,871,598 | 2/1959 | Pawelka | 40/131 R X |
| 2,928,197 | 3/1960 | Zuckerman | 40/130 C |

*Primary Examiner*—John F. Pitrelli
*Attorney, Agent, or Firm*—Howard C. Miskin

[57] ABSTRACT

An illuminated display device includes a housing having front and rear openings with which to register outer transparent face plates and superimposed inner thermoplastic translucent sheets having inwardly convex, relatively thin thermoformed logos projecting inwardly. The logos are preferably hemispheres or portions thereof, and are coated with fluorescent layers and an opaque layer is sandwiched between each sheet and plate in registry with the non-logo area of the sheets. A fluorescent lamp is disposed in the housing between the sheet-plate pairs for self contained units and can be open, such as at the top, to receive outside light.

6 Claims, 5 Drawing Figures

ILLUMINATED DISPLAY DEVICE

This application is a continuation-in-part of my earlier application Ser. No. 536,896, filed Dec. 27, 1974, now abandoned.

The present invention relates generally to improvements in display devices and it relates more particularly to an improved illuminated advertising display device.

In point of sales advertising and in advertising or displaying a trademark, trade or brand name, it is desirable that the display device or sign be highly attractive and that it strongly draws attention to the message it wishes to convey. Display devices and signs of this type which have been heretofore available or proposed, possess numerous drawbacks and disadvantages. They either fail in their purpose of drawing attention thereto and be highly attractive and easy to read or they are complex, fragile and expensive devices and otherwise leave much to be desired. An example is neon signs, which are highly visible, but expensive, noisy, easily damaged and costly to operate.

It is a principal object of the present invention to provide an improved display device, which is economical to operate.

Another object of the present invention is to provide an improved illuminated sign or display device which has high light intensity and visual acuity at the logo.

Still another object of the present invention is to provide an improved sign carrying a uniquely illuminated logo such as a trademark, trade or brand name or other information.

A further object of the present invention is to provide an illuminated display device of the above nature characterized by its highly attractive appearance, attention drawing character, simplicity, ruggedness, low cost and great versatility and adaptability.

The above and other objects of the present invention will become apparent from a reading of the following description taken in conjunction with the accompanying drawing which illustrates a preferred embodiment thereof.

In a sense, the present invention contemplates the provision of an illuminated display device including a housing having a front opening, a light transmissive sheet supported by the housing and registering with the housing front opening and having a rearwardly projecting representation area formed thereon, the representation area possessing fluorescent properties, an opaque layer registering with the area of the sheet other than the representation area, and a light source received in the housing behind the sheet.

In preferred form of the improved device the housing consists of a box frame having front and rear openings, which are closed by transparent face plates. A representation sheet of a translucent thermoplastic polymeric resin is superimposed on the inside face of each face plate and has an inwardly directed, inwardly convex logo or the like, preferably hemispherical or portions thereof, thermoformed thereon, the thermoformed areas being of lesser thickness than the sheet of flat areas. A layer of opaque material is sandwiched between the confronting flat parallel faces of the representation sheet and face plate to leave the logos visually exposed and the formed representation areas are coated with a light transmissive fluorescent layer. A fluorescent light is located in the housing intermediate the representation sheets. If desired, the housing could be open to receive reflective light and then direct that light through the representation sheets.

The improved display device provides a bright appearing sign by reason of the logo as representation receiving a maximum of the light from the source, to provide maximum intensity. The logo is closest to the light by its inverse thermoform configuration and the hemisphere configuration collects the light and provides a maximum of surface exposed to the light. The device is simple, rugged and of low cost, is of highly attractive and attention drawing appearance and is of great versatility and adaptability.

Figure 1:
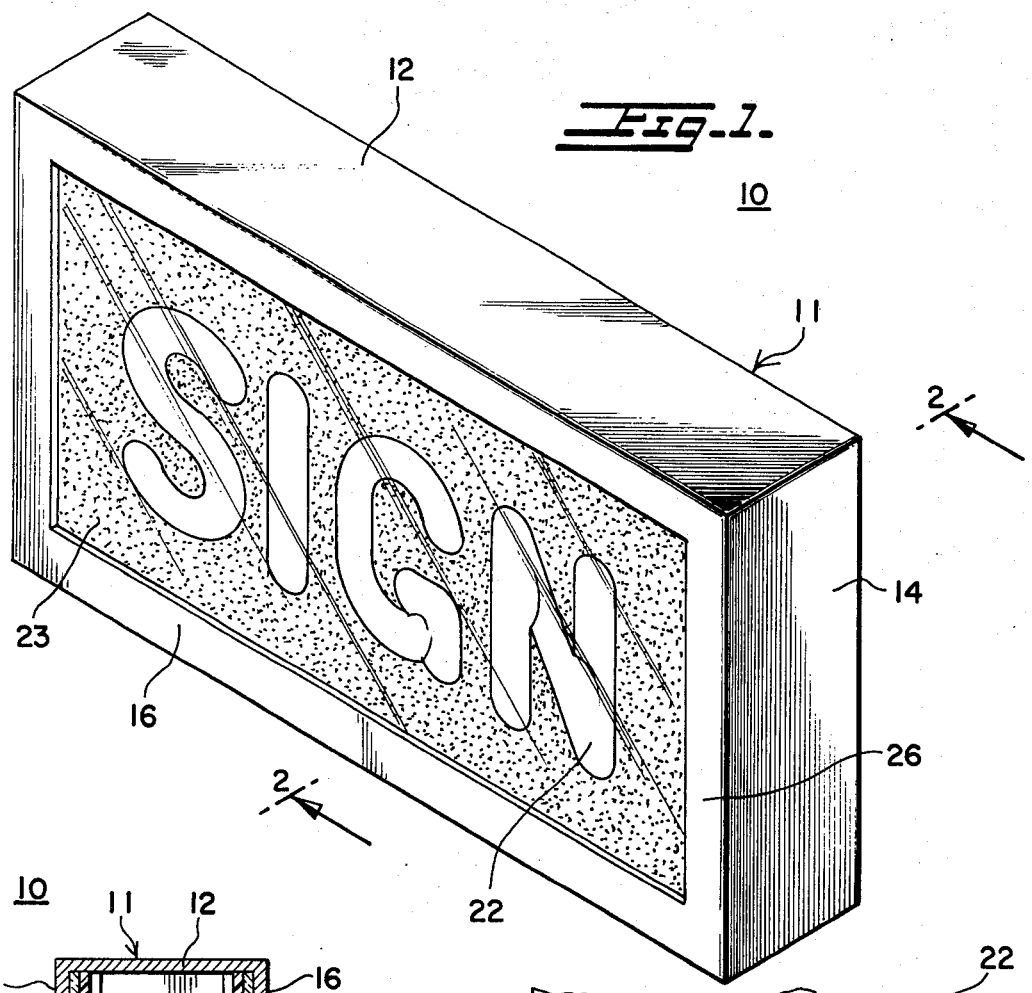
FIG. 1 is a front perspective view of an illuminated display device embodying the present invention.
Figure 2:
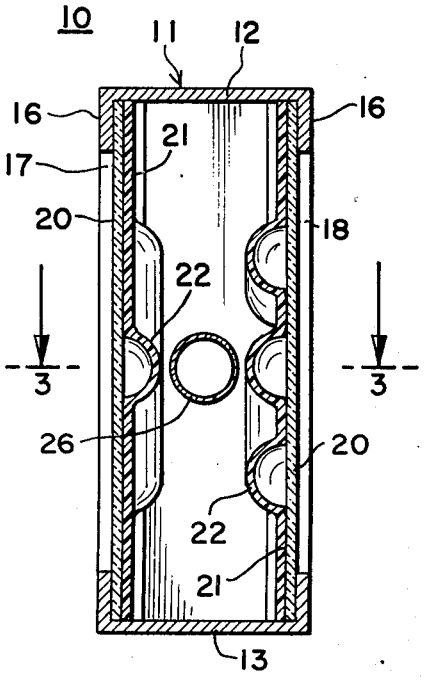
FIG. 2 is a sectional view taken along line 2—2 in FIG. 1.
Figure 3:
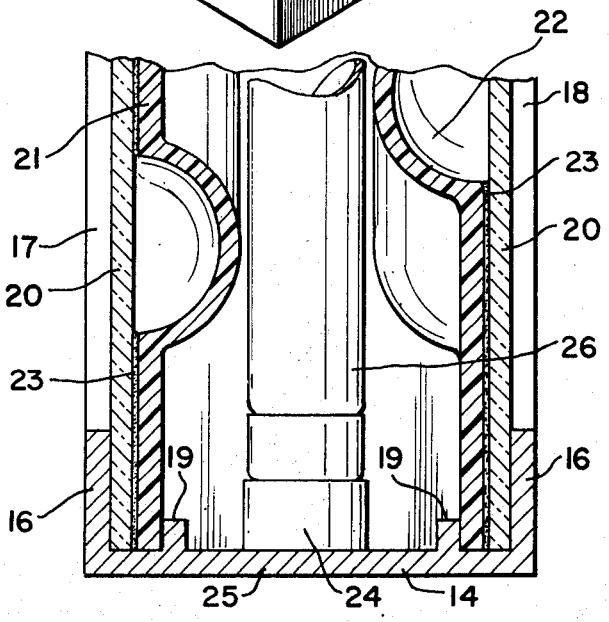
FIG. 3 is an enlarged fragmentary sectional view taken along line 3—3 in FIG. 2.

Referring now to the drawing, FIGS. 1–3 illustrate a preferred embodiment of the present invention, the reference numeral 10 generally designates the improved display device which is illustrated by way of example as being of rectangular configuration, it being understood that the device 10 may be of any desired shape. The display device 10 comprises a housing 11 in the form of a rectangular frame having rectangular horizontal top and bottom walls 12 and 13 and rectangular vertical end walls 14. Directed inwardly from the edges of the frame walls 12, 13 and 14 are bezel defining inwardly directed front and rear coplaner flanges 16 which delineate the front and rear housing openings 17 and 18 respectively. Rectangular vertical ridges 19 project longitudinally inwardly from the opposite end walls 14 and extend vertically and are equi-distant from the end flanges 16 to define grooves therewith. The housing 11 may be formed of any suitable material such as metal, wood, synthetic organic polymeric resin, for example, high impact polystyrene or the like and may be colored or decorated as desired. The device 10 may be mounted or supported as desired, for example, it may be countertop mounted, chain suspended and the like.

Registering with each of the front and rear openings or windows 17 and 18 are an assembly of an outer face plate 20 and an inner representation sheet 21. The plate 20 and sheet 21 are, except as hereinafter set forth, flat, rectangular and coextensive, the front borders of the face plates 20 abutting the rear faces of corresponding flanges 16 and the rear end borders of the sheets 21 being engaged by the ridges 19 to lock the plates 20 and sheets 21 in position.

Each of the sheets 21 is formed of a translucent thermoplastic resin, for example, translucent polystyrene sheet, and has thermoformed therein, such as by vacuum forming, a logo 22 or any other desired representation or design. The logo 22 projects inwardly into the interior of the housing 11 and is curved and inwardly convex and outwardly concave. Preferably the logo configuration is hemispherical or segments of a hemisphere. Moreover, due to the forming and stretching, the wall thickness of the logo projections is less than the thickness of the remaining flat portion of the sheet 21. The logo projections 22 are rendered fluorescent by being coated on at least one face thereof with a fluorescent paint or other fluorescent coating, for example, by the application by spraying of two coats of Ray-flow paint to the front of the sheet 21. The sheet 21 is advantageously ultraviolet inhibited and the fluorescent coated face of the sheet 21 is covered with a clear overcoat of an ultraviolet inhibitor.

Each of the face plates 20 is transparent and formed of glass, a clear polymeric resin or the like. An opaque layer or coating 23 is sandwiched between the flat confronting faces of the plate 20 and sheet 21 of each pair thereof, the layer 23 advantageously being applied to the inside face of the plate 20, such as by silk screening, the layer 23 being absent in those areas registering with the logo 22. The layer 23 may be multilaminar, advantageously having a highly reflecting or specular inside layer confronting the sheet 21.

A pair of lamp sockets 24 are mounted on the inside faces of end walls 14 and replaceably support a longitudinally extending medially located fluorescent lamp 26 which is intermediate the sheets 21 and spaced shortly inwardly of the inner extremities of the logo projections 22. Also located in the housing 11 are a ballast and a starter, not shown, which are connected in circuit with each other and the sockets 24 and a power cord, and, if desired, a power switch, so as to permit the energization of fluorescent lamp 26.

Upon energization of the lamp 26, the logo projections 22 are back illuminated and by reason of their curved configuration, refractive properties and relationship, their fluorescent properties consequent to the fluorescent coating thereof and the opaque layer 23, they present a unique highly attractive and attention drawing appearance. The hemispherical curved surface of logo 22 facing the light source 26 provides greater light intensity, since the area exposed to the light is greater than a flatter configuration. The hemisphere configuration provides maximum intensity by its light gathering characteristics. A portion of a sphere provides better light intensity from back lighting than other shapes, and acts as a lens in its light gathering capabilities. This appearance is further enhanced by the transparent face plates 20 and their association with the sheets 21, the reduced thickness and closeness to the light source of the logo or representation projections 22, and the specular or highly reflective inside faces of the opaque layer 23 which increases the light emission and intensity of the logos.

Figures 4, 5:
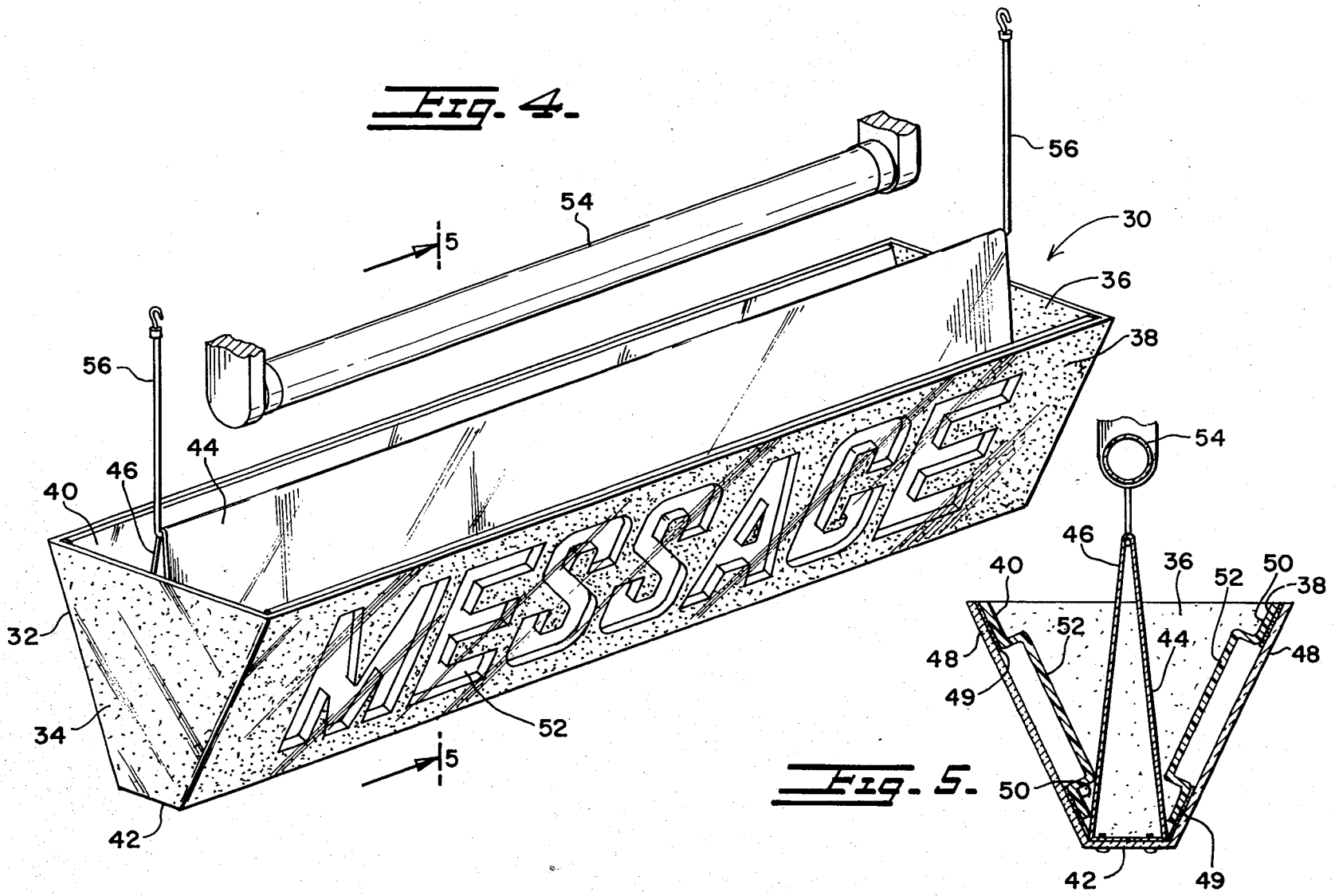
FIG. 4 is a perspective view of another embodiment of the present invention.
FIG. 5 is a sectional view taken along line 5—5 of FIG. 4.

Referring now to the embodiment shown in FIGS. 4 and 5, the reference numeral 30 generally designates the improved display device, which is illustrated by way of example, as being trapezoidal configuration in cross section, it being understood that the device 30 may be of any desired shape. Device 30 comprises a housing 32 having end walls 34 and 36 in the form of a frustum of triangles and generally rectangular side walls or openings 38 and 40 and a rectangular shaped bottom wall 42. The top surface of device 30 is open and the interior is generally hollow. Side walls 38 and 40 are tapered downwardly as shown in FIG. 4 so that bottom wall 42 is smaller in area than the open upper area. Internally located within the space bounded by walls 34, 36, 38, 40 and 42 are downwardly tapered longitudinally extending inner walls 44 and 46. The outwardly directed surfaces of walls 44 and 46 are highly reflective, such as highly polished aluminum or stainless steel or reflective, metal bonded plastic materials.

Walls 38 and 40 are formed of an assembly of an outer face plate 48 and an inner representation sheet 50. Outer plate 48 and inner sheet 50 correspond to plate 20 and sheet 21 of the first embodiment described above. Representation sheet 50 contains the logo 52 which projects inwardly into the interior of the housing, as seen best in FIG. 5. Logo 52 corresponds in form and construction to logo 22 of the embodiment described above to provide the highly visible appearance of the logo described hereinafter.

As shown best in FIG. 5, reflected light from the reflective surface of 44 is directed toward wall 38 and similarly light reflected from surface 46 is directed towards wall 40. This reflective light is transmitted through the corresponding logo 52 in the same manner as described above with respect to logo 22 in the first embodiment. Therefore, ceiling lights, such as illustrated as fluorescent light source 54 is received within housing 32 and reflected from reflective surfaces 44 and 46 respectively, which then transmits the light through the logo 52 to provide a highly visible logo. While fluorescent light was illustrated in this embodiment and the other embodiment described above, other light sources could be used, such as incandescent, cold cathode, ambient or other. As illustrated, housing 32 is illustratively shown attached to the ceiling by a chain or strand 56, however other methods of attachment or support can be used. Also as shown, instead of the housing 32 being longitudinal, a toroidal configuration can be used. As shown, the angle formed between corresponding reflective surfaces and the surface containing the logo is that best directed to receive and transmit light reflected therefrom.

In both embodiments, the logos 22 and 52 provide easily visible and readable signs, in all types of ambient light. The hemispherical areas collect the light to provide greater brilliance and visual acuity to the logo. The units are not easily vandalized and relatively inexpensive.

While there has been described and illustrated several preferred embodiments of the present invention, it is apparent that numerous alterations, omissions and additions may be made without departing from the spirit thereof. While a fluorescent paint has been disclosed as used on the logo, other coloring materials may be used, such as by tinting the plastic sheet 21. Also, while an opaque coating 23 was disclosed being applied to sheet 20, sheet 20 could be tinted as a different translucent coating 23 could be used to provide a contrast in color effect. Further, the representation sheet was described illustratively as made from a thermoforming material; however, other materials could be used to obtain the desired configuration such as thermosetting. Also, besides vacuum forming the representation sheet, other forming processes could be used, such as injection molding, casting pressure forming and even blow molding. Other geometric shapes or configurations could be used than those described in either configuration, such as tubular, conical, cubical or the like.

I claim:

1. An illuminated display device comprising a housing having a front opening, a light transmissive sheet supported by said housing and registering with said opening and having a rearwardly convex curved projecting representation area of hemispherical cross-sectional configuration formed thereon, said curved representation area having a thickness less than the thickness of the rest of said sheet and possessing fluorescent properties for brightening the image, a substantially opaque layer registering with the area of said sheet other than said representation area, and a fluorescent lamp within said housing and rearwardly of said sheet.

2. The illuminated display device of claim 1 including a transparent face plate superimposed on the front face of said representation sheet.

3. The illuminated display device of claim 2 wherein said representation sheet is formed of a translucent theremoplastic polymeric resin and said representation area is thermoformed.

4. The illumination device of claim 1 wherein said representation area is coated with a fluorescent layer to impart said fluorescent properties thereto.

5. The illuminating device of claim 1 wherein said housing has a rear opening and comprising a rear second light transmissive sheet with a second representation area and a rear second face plate registering with said rear opening.

6. An illuminated display device comprising a housing, having a front opening, a light transmissive sheet supported by said housing and registering with said opening and having a rearwardly convex curved projecting representation area of hemispherical cross-sectional configuration formed thereon, said representation area having a thickness less than the thickness of the rest of said sheet and possessing fluorescent properties, a substantially opaque layer registering with the area of said sheet other than said representation area, said housing being open at one side to receive outside light, a reflective surface disposed within said housing to receive said light from the open side and to reflect said light toward the representation area, said light transmissive sheet and said reflective surface being angularly disposed relative to each other at an angle less than 90 degrees.

* * * * *